US005824113A

United States Patent [19]

Hojo

[11] Patent Number: 5,824,113

[45] Date of Patent: Oct. 20, 1998

[54] METHOD OF MODIFYING KERATIN FIBER

[76] Inventor: Hiroshi Hojo, 105 Fumizoe, Hidakacho, Kounan-shi, Aichi-ken, Japan

[21] Appl. No.: 784,962

[22] Filed: Jan. 16, 1997

Related U.S. Application Data

[63] Continuation of Ser. No. 456,573, Jun. 1, 1995, abandoned.

[30] Foreign Application Priority Data

| | | | |
|---|---|---|---|
| Jun. 7, 1994 | [JP] | Japan | 6-125092 |
| Nov. 28, 1994 | [JP] | Japan | 6-293502 |
| Apr. 4, 1995 | [JP] | Japan | 7-078633 |

[51] Int. Cl.[6] ..... D06M 13/262; D06M 11/50

[52] U.S. Cl. ..... 8/128.3; 8/128.1

[58] Field of Search ..... 8/128.3, 128.1

[56] References Cited

U.S. PATENT DOCUMENTS

| | | | |
|---|---|---|---|
| 2,599,977 | 6/1952 | Cunliffe et al. | 8/128.1 |
| 4,396,388 | 8/1983 | Hojo et al. | 8/94.14 |
| 5,304,378 | 4/1994 | Koga et al. | 424/445 |

*Primary Examiner*—Margaret Einsmann
*Attorney, Agent, or Firm*—Armstrong, Westerman, Hattori, McLeland & Naughton

[57] ABSTRACT

An improved method of modifying keratin fiber represented by wool is disclosed. Mechanical force is applied to keratin fiber in the presence of an aqueous solution of a transition metal salt to weaken and destroy the structure of the parts under the keratin layers in scales (surface cells) so that the transition metal may be introduced in the under-keratin layers locally at high a concentration. Then, the keratin fiber is immersed in a bath containing oxidizing agents such as hydrogen peroxide and monopersulfuric acid. The oxidizing agents are decomposed by catalytic effect of the transition metal. Mainly due to pressure of oxygen gas evolved by the decomposition keratin layers, which are scales on the keratin fiber, are peeled off. Thus, it is possible to remove only the keratin parts, which are not agreeable to the touch, without damaging the non-keratin protein, and to provide modified fiber which substantially contains no remaining metal. High shrink proof effect may be achieved without using the conventional chlorine compounds as the oxidizing agents.

19 Claims, No Drawings

METHOD OF MODIFYING KERATIN FIBER

This application is a continuation of application Ser. No. 08/456,573 filed Jun. 1, 1995, now abandoned.

BACKGROUND OF THE INVENTION

1. Field in the Industry

The present invention concerns improvement in the method of modifying keratin fibers or animal fibers, typically, wool. The method of this invention enables removal of keratin layers from the scales (outer surface cells) by using a non-chlorine based oxidizing agent which has less influence on the environment.

2. State of the Art

Felting, which is a drawback of wool, results from the deformation caused by the difference in swelling extents due to the difference in water absorbability of keratin layers and non-keratin protein layers constructing the cuticular cells which make-up to the keratin fibers. Various improved methods have been tried to remove the surface cells. The conventional methods, however, tend to damage the fiber bodies.

The inventor established, as a technology of shrink-proofing and high-grading of wool, a method of stripping wool scales using the catalytic effect of transition metals as disclosed in (Japanese Patent Publication No.62-19540). The method comprises immersing an animal fiber in an aqueous solution of transition metal ions so that the metal ions may be adsorbed by hydrophilic parts opening at the fiber surfaces, i.e., the jointing parts of the surface cells and hydrophilic protein parts adjacent to the former parts, treating the fiber with an aqueous solution of an oxidizing agent of a high concentration to cause catalytic oxidation decomposition catalyzed by metal ion-protein complex, and thus destroying and peeling the surface cells from inside thereof.

The inventor further discovered that the hydrophilic shrink proof wool thus obtained is useful as a wound dressing material for human skins through the research made with some coinventors, and disclosed also this technology (Japanese Patent Disclosure No.04-82561).

During the above research the inventors found that the modified wool and the non-treated wool exhibit different antibacterial activities. As the results of the continued research, I have discovered the facts that wool will obtain various useful properties such as antibacterial activity by being subjected to the treatment comprising removing keratin or exocuticules which form the outmost sides of the surface cells of wool fiber to expose endocuticules which are of hydrophilic non-keratin protein and that these properties are durable. This discovery was also disclosed (Japanese Patent Application No.05-283698).

In the conventional methods of modifying keratin fibers there has been used as the oxidizing agents chlorine compounds such as sodium hypochlorite because of their strong oxidative action which even dissolves keratin fiber. Use of this kind of oxidizing agents inevitably results in transfer of the chlorine compounds into waste water, and in view of the effluent limitation for absorbent organic halogen compounds provided for the purpose of global prevention of dioxin formation, it will not be permissible to use the chlorine compounds in the future.

It is therefore desirable to practice modification of the keratin fiber using commercially available non-chlorine based oxidizing agents, which are considered to be "friendly to the environment" such as hydrogen peroxide or peroxy compounds.

This kind of oxidizing agent, however, has a weaker oxidizing power, which is of a level suitable for bleaching wool but insufficient for removing scales therefrom. In fact, anti-felting treatment using non-chlorine based oxidizing agents needs long period of time for treatment, results in serious damage of wool fiber, and shrink proof effect is still not satisfactory. Thus, it is actual state of the technology that machine washable products can hardly be produced with the aid of resin treatment. Further, epichlorohydrine polyamide resin used as a masking agent at the shrink proof treatment contains chlorine, and therefore, use of this compound is not desirable.

The transition metals used as the catalyst for the oxidation reaction have been used, as described above, in the form of ions in an aqueous bath. In general, the keratin fiber is immersed in an aqueous solution of a transition metal salt under acidic conditions which ionize the metal. The hydrophilic non-keratin protein or endocuticles swell and the transition metal ions are adsorbed by the swollen protein, and the catalyst is thus distributed in the fiber. According to this technology, oxidation decomposition occurs all over the endocuticles and, even though scale-removing is achieved, the wool fiber will be damaged. It is desired that the oxidation decomposition is localized in the under keratin layers which are adjacent to the keratin layers of the scales and that non-keratin protein parts are, in view of the fact that it is jointed to the inner parts of the fiber, maintained as they are.

The inventor tried to apply mechanical force to the keratin fiber at the time of distributing the catalyst, and got better results. In the surface cells of the keratin fiber keratin parts are relatively rigid and non-keratin protein parts are relatively soft, and thus, when strong mechanical force is applied to the fiber considerable distortion occurs in the non-keratin protein parts adjacent to the keratin parts to the extent that the non-keratin parts are weakened and destroyed. This causes absorption of the metal ions by these parts at the concentrations higher than those in the other parts. Thus, it will be possible to oxidize concentratedly the non-keratin protein parts adjacent to the keratin parts to remove the keratin layers.

Further research, however, revealed that the catalytic effect of transition metal ions is not so strong if they are absorbed by the protein. Particularly, non-keratin protein of the cuticular cells which contain many anionic groups tends to form cheleted complexes with the transition metal ions which exhibit moderated catalytic effect. It is hence difficult to carry out removal of keratin layers using commercially available non-chlorine based oxidizing agents having weaker oxidizing power. Further problem resides in the fact that the transition metal remains in the fiber at a high concentration and it is difficult to remove the metal from the fiber. The remaining metal is, not only undesirable for the latter steps of processing such as dyeing, but also objectionable in use of the fiber products.

SUMMARY OF THE INVENTION

The object of the present invention is to provide a method of modifying the above mentioned keratin fibers, which uses non-chlorine based oxidizing agents to achieve at least the same effect as that of chlorine based oxidizing agents, which may retain functional parts such as non-keratin protein parts, and in which the transition metal used as the catalyst does not substantially remain in the modified fiber products.

The method of modifying keratin fiber of the present invention is characterized by the sequence of the following steps:

a) a transition metal salt impregnation step which comprises applying mechanical force to a keratin fiber, in the presence of an aqueous solution of a transition metal salt in which precipitation may easily occur by decrease of water content, change in pH or addition of ions of a metal other than the transition metal, so as to cause, due to difference in mechanical properties of the keratin layer and the non-keratin protein layer in the cuticular cells, weakening and destroying the structure of the under-keratin layers jointed to the inside of the keratin layers, and to introduce the transition metal salt solution in the under-keratin layers;

b) a catalyst precipitation step which comprises one or more steps selected from decreasing the water content of the transition metal salt solution, changing pH of the solution, and adding ions of a different kind of metal salt, to cause precipitation and distribution of the catalyst solution for an oxidation reaction in the under-keratin layers; and c) a keratin layers removing step which comprises reacting a non-chlorine base oxidizing agent with the keratin fiber under catalytic effect of the transition metal to cause a rapid reaction at the under-keratin layers so that the keratin layers may be removed from the under-keratin layers and the non-keratin protein layers may be exposed.

DETAILED EXPLANATION OF THE PREFERRED EMBODIMENTS

The term "keratin fiber" means body hair of land mammals including animal fibers such as wool of sheep, llama and alpaca, and even human hair. The form of the fiber may include any form such as raw fiber, yarn, knitted fabric, woven fabric and non-woven fabric. The term "precipitation" of the transition metal salt is used to include deposition of the metal salt as it is, deposition in the form of a metal hydroxide, and even deposition in the form of a reduced state to the metal.

As the transition metal salts, a water soluble salt of a metal selected from Cu, Fe, Ni, Co, Mn, Cr and Zn may be used. Though aqueous solutions of these salts electrolyze to be weak acidic or alkaline solutions, addition of an alkali or an acid to bring the pH of the solution to a value just before which precipitation occurs makes it possible to substantially avoid complexation of the ions with the legands of non-keratin protein. There has been restriction on use of Fe as the transition metal catalyst because it is, if it remains in the fiber, objectionable for dyeing step. According to the invention, however, little Fe remains in the modified fiber, and therefore, use of Fe will cause no trouble. Suitable concentrations of the transition metal salts in the solutions ranges from several tens to one hundred and several tens ppm of the metal ions.

Typical means for facilitating precipitation of the transition metal salts is change in pH. Decrease of water content in the system and addition of ions of a metal other than the transition metal to the system are also effective. These means may be used either solely or in combination of the two or more. Decrease of water content includes, in addition to decrease of the absolute quantity of water in the aqueous system, addition of a strong electrolyte neutral salt at a high concentration so as to decrease free water which can be combined to the transition metal salt. An example of addition of the different ions is combined use of $Cu^{++}$to $Fe^{++}$as shown in the working example described later. Because of the difference in the ionization tendencies $Cu^{++}$receives electrons from $Fe^{++}$and deposits in the form of the metal. On the other hand, $Fe^{++}$it self is oxidized in water by dissolved oxygen to $Fe^{+++}$and tends to precipitate from water as $Fe(OH)_3$.

The catalyst precipitation step is preferably carried out in the presence of a strong electrolyte neutral salt at a high concentration to suppress swelling of non-keratin protein parts. This is effective for facilitating precipitation of the transition metal salt catalyst. As the strong electrolyte neutral salts are those of metals having ionization tendencies higher than that of the transition metal used as the catalyst. Conventional salts are mineral acid salts of sodium or potassium, such as sodium chloride and sodium sulfate. Because addition of the strong electrolyte neutral salts is done for the purpose of depriving combined water of the transition metal ions, it is effective to add the salt at such a high concentration as saturation or near saturation.

The mechanical force to be applied to the keratin fiber may be of various form such as bending and twisting. Typical mechanical force is bending of 20% or higher, preferably, around 30%, and relaxation, which are applied repeatedly.

The aqueous solution of the transition metal salt may be in the form of a suspension or an emulsion in which droplets of the aqueous solution are dispersed in an organic solvent. These embodiments enable lowering of the bath ratios. Dispersion or emulsification can be easily carried out with use of a suitable surface active agent.

Oxidizing agents may be one or more compounds selected from monopersulfuric acid or the salts thereof, dipersulfuric acid or the salts thereof, hydrogen persulfates, performic acid, and peracetic acid and the salts thereof. These compounds decompose in an alkaline aqueous bath of a pH of 7.5–10.5, and exhibit strong oxidizing power. In case of using hydrogen peroxide, good results will be obtained by combined use with an oxidizing acid.

In step (a) application of mechanical force to the keratin fiber in the presence of the aqueous solution of a transition metal salt in which precipitation of the salt is facilitated by any one of the means as noted above causes invasion of the aqueous solution of the salt concentratedly to the under-keratin layers of the non-keratin protein. Decrease of water content at this stage results in precipitation of the transition metal salt which exceeded the solubility limit. Such a condition may be achieved, not only by drying the fiber, but also, to some extent, by addition of the solution of the strong electrolyte neutral salt at a high concentration.

The strong electrolyte neutral salt also has an effect to deprive combined water of cuticular cells and to suppress swelling of the cells by water. Inside the keratin fiber non-keratin protein forms network to joint the keratin cells, and these parts swell in an aqueous system and functions like water channels, through which the transition metal salt diffuses into deep locations and thus, oxidation decomposition occurs even inside of the fiber. If the swelling is suppressed, then the transition metal does not diffuse into the deep locations, quantity of the metal salt which invades into the deep location, to which invasion is not desirable, will be lowered.

The transition metal salt used in the present invention forms, when dissolved in an aqueous solution, aqua-complex ions which gives a pH in acidic range. If the pH is forced to be in alkaline side, the metal precipitates as a hydroxide. For example, the following reactions:

$$FeCl_3+3NaOH=Fe(OH)_3+3NaCl$$

$$NiCl_2+2NaOH=Ni(OH)_2+2NaCl$$

Experiments using dilute solutions gave the following results.

| Transition Metal Salt | concentration (ppm) | pH of the solution | pH at which precipitation occurs * |
|---|---|---|---|
| $CuSO_4.5H_2O$ | 50.9 | 5.86 | 6.09 |
| $NiCl_2.6H_2O$ | 49.4 | 6.80 | 8.01 |
| $CoCl_2.6H_2O$ | 49.5 | 6.60 | 7.92 |
| $ZnSO_4.7H_2O$ | 45.5 | 6.33 | 7.05 |
| $MnSO_4$ | 40.4 | 6.30 | 8.90 |

* Under dropwise addition of NaOH dilute solution the value of pH at which appreciable precipitation occurs.

On the other hand, transition metal complex ions which form aqueous solutions at alkaline solution, such as tetraammine copper (II), tetraammine zinc (II) or those of hydroxy-type will give hydroxides when acid is added to decrease the pH to neutral region. For example, the reaction of:

$$[Cu(NH_3)_4]^{--}+4H^+\rightarrow Cu(OH)_2$$

Using this kind of reaction to cause precipitation of hydroxides of the transition metals, slight change in pH or addition of a small amount of alkali or acid makes it possible to form non-complex type catalyst locally at the above noted under keratin layers.

Application of an oxidizing agent under this weak alkaline condition which facilitates decomposition of the oxidizing agent causes decomposition of the oxidizing agent more drastically in the under keratin layers, where the catalyst exists locally in the non-complex form, than in the other parts. In case where hydrogen peroxide is used, decomposition of $H_2O_2$ 1 mole results in generation of ½ mole oxygen gas and, at the same time, considerable heat is generated.

$$H_2O_2\rightarrow H_2O+\tfrac{1}{2}O_2+23.45\ \text{Kcal}$$

A gas of 1 mole shares 22.4 liters at 0° C. and under normal pressure. Decomposition of 34 g of $H_2O_2$ causes generation of 11.2 liters of oxygen gas, which results in rapid expansion of the volume to about 330 times. The heat generated by the reaction accelerates decomposition of the oxidizing agent and expansion of the gas. It is considered that, mainly due to the pressure of the expanding gas, the keratin layers are peeled off and removed from the fiber. The transition metals existing at the under-keratin layers in the form of salts or hydroxides are oxidized to become soluble ions again which dissolve into the reaction medium and leave the fiber. Metal components, even if remains in a very small amount, will be readily dissolved by acid treatment and therefore, they will not substantially remain on the fiber. Thus, non-keratin protein remains without being decomposed. Modification of fiber according to the present method is thus particularly preferable for use of the modified fiber as a wound dressing material utilizing the antibacterial activity thereof.

The method of modifying keratin fiber represented by wool according to the present invention enables peeling off the keratin parts which form scales without damaging the non-keratin protein of the wool by using no chlorine-based oxidizing agents and obtaining high shrink proof effect equivalent to that obtained by the conventional oxidizing agents.

Thus, it is possible to avoid exhausting organic chlorine compounds to waste water accompanying use of chlorine compounds, and harmless agents can be used in the dyeing step. This lightens load to the environment and provide modified fiber in which substantially no metal remains.

The surfaces of the modified fiber have strong antibacterial activities. These activities are so useful that the modified fiber will find use in various fields such as clothing and bedding.

EXAMPLE 1

A cuprous sulfate solution containing 40 ppm as $Cu^{++}$ions was prepared. (The water used is, throughout the examples below, a softened water having a pH of 6.3 which passed through an ion-exchange apparatus for industrial use.) The pH of this solution was 5.6 and it was ascertained that precipitation of $Cu(OH)_2$ occurs at pH 6.1. An aqueous solution of $NaHCO_3$ was added to the above prepared solution to adjust the pH to 5.8.

Sliver (30 g/m) of Merino wool produced in Australia (averaged fineness: 21.6 $\mu$m) was immersed in the cuprous sulfate solution at 20° C., and extension of about 20% was applied on the fiber in the bath six times in 4 minutes. Then, an aqueous solution of $NaHCO_3$ was added to increase the final pH to 7.3, and the fiber was dehydrated with an absorbing dehydrator to adjust the water content to 60%.

A 30% aqueous solution of commercially available hydrogen peroxide (concentration 35%) received sodium hydroxide solution to adjust the pH to 9.0, and warmed to 65° C. The above treated sliver was immersed in this warm solution for 3 minutes. Active bubbling and dissolution of copper into the bath in brown color were observed. Wool fiber was dispersed in the solution and it was appreciated that the water-repellent keratin parts fell off from the fiber.

The above oxidation-treated wool sliver was immersed in an aqueous solution of 5 g/l sodium meta hydrogen sulfite to inhibit effect of the oxidizing agent. After being treated by immersing in an acid bath, pH of which was adjusted to 5.0, the wool sliver was rinsed and received spinning oil of 0.6%owf, and then dehydrated and dried.

The sliver thus treated was then spanned to a yarn of ¾₈N with a conventional worsted spinning machine, and the yarn was wound on a hank and dyed navy-blue color in an injection type hank dyer with a reactive dye. The dyed yarn was then knitted up to a sweater for men. The sweater was tested by practical repeated washing test defined by JIS L0217-103 for 20 times and aerial shrinkage percentage was measured. The values obtained were within 3%, which proved a high shrink proof effect of the treatment.

The baths for the above described treatments may be used in lower bath ratios, and reused. Disposal of the waste water has no particular problems, because copper in the bath can be easily recovered by precipitation.

Pre-scouring of the wool, which is usually done in the conventional dyeing, was not necessary in the above working example. This seems to be due to the fact that the surface of the fiber is hydrophilic and removal of the spinning oil can readily be done during dyeing. Also, neutral salts usually added to the dyeing bath were not necessary, and the period of time to keep the dyeing solution in boiling state can be so short as 20 minutes, which is less than one third of normal period in the conventional dyeing. For fast dyeing of the wool in deep colors chromium dyes have usually been used. However, the wool which was subjected to the above treatment can be dyed, even with reactive dyes for cotton which contains no chlorine in reactive groups, to such a beautiful color as deep as 2–3 times of dyed cotton. In regard to the dyeing step the present method makes it possible to lighten the burden to the environment.

The above sweater for men was subjected to antibacterial incubation test by bacterial number-counting method using *Staphylococcus aureus* which was established by Conference for Sanitary Processing of Fiber Products. Even after 10 times of repeated washing difference of bacterial number compared with that of standard cotton white cloth was found to be 3.4, which exhibits such a high antibacterial activity as that of the antibacterial processing products using particular agents.

EXAMPLE 2

An aqueous solution of nickel acetate containing 47 ppm $Ni^{++}$ions was prepared, and it was ascertained that, by addition of alkali to the solution, $Ni(OH)_2$ precipitates when pH reaches 8.0. Merino wool produced in Tasmania (averaged fineness: 19.0 $\mu$m) was spanned to a yarn of 3/60 by worsted spinning, and the yarn was woven to a fabric which is used as a material for men's cloths. Sodium sulfate 5.0 wt.% was added to the above nickel acetate solution and the fabric was immersed in the admixture at 25° C. and, as done in Example 1, extension of about 20% was applied six times in four minutes. The fabric was then taken out from the bath and dehydrated to liquid content of about 70%.

To an aqueous solution of 3% monohydrogenpersulfate (bearing a trade mark "Oxon"), which contains about 50 ppm of active oxygen, sodium hydroxide was added to adjust the pH to 9.0, and the solution was warmed to 30° C. The above fabric was immersed in the solution. About 2 minutes later, the fabric developed in the solution and it was appreciated that the surface of the fabric became hydrophilic.

The fabric was taken off from the solution and rinsed, and then, immersed in a bath of sodium meta hydrogen sulfite 5 g/l to inhibit effect of the oxidizing agent. The alkali remaining in the fabric was neutralized in an acid bath of pH 5.0, and the fabric was rinsed and dried.

The wool fabric thus modified was subjected to the tests of JIS L1902 Hallo method, the above noted antibacterial activity test using the bacterial number-counting method, and JIS Z2911 antimould test. The modified wool exhibited antibacterial activity not only to *Staphylococcus aureus* but also to some other bacteria such as *Klebsiella pmeumoniae, Escherichia coli, Pseudomonas aeruginosa, Clostridium welchii,* and the antibacterial values were equivalent to those exhibited by the wool fabrics treated with antibacterial agents. Further, the modified wool was mould-resistant to wide range of moulds such as Chaetomium and Trichophyton. Improvement in dyeability and other properties was appreciated as in the products of Example 1.

EXAMPLE 3

An aqueous solution of cobalt chloride containing 48 ppm of $Co^{++}$ions was prepared. $NaHCO_3$ was added to the solution to adjust the pH from initial 6.6 to final 7.2. A sliver (25 g/m) of Merino wool produced in Australia (averaged fineness: 18.6 $\mu$m) was immersed in the solution at 20° C., and extension of about 20% was applied six times in four minutes to the sliver. During application of the extension pH of the solution was raised with $NaHCO_3$ to the final value, 8.2. After being absorbing water and dehydrating the wool sliver was dried in a high frequency dryer of output 100 KW to liquid content of 25%owf.

The wool sliver treated and dried as above was immersed in a bath of mixed oxidizing agents prepared by adding 2 weight parts of monopersulfuric acid to 98 weight parts of hydrogen peroxide ($H_2O_2$ 35%), and the liquid content was adjusted to 40% with a roller mangle.

The wool sliver treated by oxidation was immersed in a $NaCO_3$ aqueous solution, pH of which was previously adjusted to 10.3, at 40° C. After a short period of time bubbles occurred in the solution, the bath turbid white, and the wool fiber became hydrophilic and dispersed in the solution. This shows that the water repellent keratin scales of cuticular cells peeled off. The fiber was then treated with a bath containing 5 g/l sodium meta hydrogen hyposulfite having a pH adjusted to 7.5 with soda ash to inhibit the effect of the oxidizing agent. After thorough rinsing spinning oil 0.6%owf was given to the fiber and the fiber was dehydrated and dried.

The sliver thus obtained was spanned to an wool yarn of 2/72N and the yarn was knitted to a 26 G plain stitch . The knitted product exhibited shrink resistant property of aerial shrinkage percentage 1.6% after 5 times of washing defined by IWS, TM-31, as well as the strength and stretchability better than those of the similar wool products.

EXAMPLE 4

A sliver (25 g/m) of a Merino wool produced in Australia (averaged fineness: 19.6 $\mu$m) was immersed in a mixed aqueous solution of copper sulfate and ferrous ammonium sulfate containing $Cu^{++}$40 ppm and $Fe^{++}$100 ppm at 25° C. As done in Example 1, extension of about 20% was applied to the wool for six times in four minutes, and during the application of the mechanical force, a small amount of sodium hydroxide solution was added to the bath. Water content of the wool was then adjusted to 50 wt. % by absorbing dehydrating.

A mixed solution of 99 parts by weight of hydrogen peroxide (35%) and 1 parts by weight of monopersulfuric acid was applied to weigh 75 wt. % of the above wool with a roller mangle so that the solution of the oxidizing agents might infiltrate in the sliver. The sliver was then immersed in 3% solution of sodium carbonate anhydride at 40° C. for 2 minutes. After vigorous occurrence of bubbles dissolution of copper and iron was observed. Then, the fiber was immersed in a bath containing 3.0% sodium hydrogen sulfite so as to inhibit the oxidation reaction.

Complete removal of the keratin in cuticules was ascertained by microscopic observation of the fiber.

EXAMPLE 5

A mixed span woolen 2/24N yarn of 40% Cashmere and 60% wool purchased in the market was knitted to an endless cylinder with a socks knitter, and the knitted product was immersed in an aqueous solution of manganese chloride containing 100 ppm $Mn^{++}$ions at 20° C., and extension of about 20% was applied six times to the fiber in the bath in four minutes. During application of the mechanical force sodium hydroxide solution was gradually added to the bath to adjust the pH to finally 8.5. After dehydrating the fiber to liquid content of about 40%, a hydrogen peroxide solution (35%) was applied to the fiber to amount 90 wt. % of the fiber and the fiber was left as it was so that the solution infiltrate inside the yarn. Treatment of the yarn in 2% aqueous solution of sodium carbonate at 45° C. for 3 minutes resulted in rapid occurrence of bubbles due to decomposition of hydrogen peroxide, and the bath turned to light brown color. This seems to be caused by dissolution of manganese. Then, the fiber was immersed in a bath containing 3.0% sodium meta hydrogen sulfite and 6.0% sodium carbonate anhydride to inhibit the oxidation. Reduction treatment under acidic conditions in sodium hydrogen sulfite bath and subsequent rinsing and dehydrating-drying were carried out to complete the process.

The fiber was microscopically observed and it was ascertained that the keratin of the cuticules completely fell off and modification was achieved as desired.

The yarn was deknitted and rewound on a hank, and the yarn thus obtained was dyed by a conventional method and knitted again to a sweater with a flat knitting machine. The knitting-deknitting method enabled continuous shrink proof treatment of span woolen yarn using even short fiber, and thus the method gave span woolen knitted products which are machine washable.

EXAMPLE 6

A 2/72N wool yarn of Merino 100% wool produced in Australia was knitted with a circular knitting machine to a plain stitch for under wares. The knitted product was enrolled with a polyester net and treated in a drum-type solvent treating machine. The solvent used was prepared by dispersing aqueous solution of ferrous sulfate containing $Fe^{++}$40 ppm with sorbitan laurate in an organic solvent (the aqueous solution 0.05 cc per the solvent 1 liter). The drum was rotated for 5 minutes to apply mechanical force to the knitted fabric. During rotation of the drum a small amount of sodium alcoholate of a higher alcohol so that ferrous hydroxide may be adsorbed by the fiber. The fabric was then dehydrated and the solvent was separated.

The fabric was transferred as it was in the net into another drum-type machine for water washing and a 3% solution (active oxygen concentration about 50 ppm) of monopersufates (trade mark "Oxon"), to which sodium hydroxide was added to adjust the pH to 9.0, warmed to 30° C. was charged in the drum. The drum was rotated for 3 minutes. Iron compound of brown color dispersed in the bath and then the bath became turbid white. This showed falling off of the water repellent keratin parts.

The drum was further rotated in an aqueous solution of 5 g/l sodium meta hydrogen sulfite and 10 g/l sodium carbonate anhydride for 2 minutes, and then oxidation was inhibited. The wool fabric was rinsed with warm water, and after being treated by addition of dilute acetic acid for neutralization, and then, rinsed, dehydrated and dried to finish the process.

The knitted fabric for underwear thus modified exhibited felt-shrinkage of aerial shrinkage percentage of 5% or less even after subjected to washing test of 20 times. This showed that the processing was made uniform over the product. Itchy feeling inherent to wool at wearing given by the fabric before the processing disappeared by the modification, and it was ascertained that the cuticules were completely processed and modified to the form suitable for the materials for underwear. The fabric also exhibited good flexibility.

The process of Example 6 is useful for shrink proof treatment of the ready-made wool products.

EXAMPLE 7

A sliver of Merino wool of fineness 18.5 $\mu$m produced in Australia was subjected to conventional distilled water extraction and pH of the extract was measured to be 5.4, acidic.

Aqueous ammonia was added to a cuprous sulfate aqueous solution containing $Cu^{++}$51 ppm to cause precipitation of blue white $Cu(OH)_2$ and finally until the precipitation dissolved again as deep blue tetraammine cuprous (II) complex ions. The above wool sliver exhibiting acidic property in the thus prepared aqueous solution of $Cu^{++}$ complex ions, and extension of about 20% was applied to the wool sliver for six times in three minutes. A small amount of acetic acid was added to the bath during application of the mechanical force to decrease pH to 7.5 so that precipitation of $Cu(OH)_2$ may occur. The sliver was then dehydrated to liquid content of 40 wt. %.

A 30% hydrogen peroxide (35%) solution was impregnated to the dehydrated sliver to give 250% of the wool, and immediately, the sliver was immersed in an aqueous solution of $Na_2CO_3$, pH of which was 9.5, at 70° C. Bubbles occurred actively and the bath became turbid and turned brown, which seemed to prove peeling off of the keratin layers.

The treatment of inhibiting oxidation reaction was done as in Example 1 in an aqueous solution of sodium meta hydrogen sulfite. The sliver was rinsed with warm water, dehydrated and dried. The wool sliver was spun to 2/72N yarn and the yarn was knitted to a fabric for underwear to plain stitch of 26 G. Aerial shrinkage percentage of the fabric was measured to be, both in microscopic observation and washing test, 3% or less. The results were so good as measured in Example 1.

We claim:

1. A method of modifying keratin fibers comprising the steps of:

a) a catalyst solution impregnation step, comprising sequentially applying a mechanical force to keratin fibers by repeatedly bending or twisting the fibers to the extent of at least 20% followed by relaxation in the presence of an aqueous solution of a transition metal salt at a first pH as a catalyst to weaken and destroy non-keratin under layers jointed to keratin layers in the cuticle cells of said keratin fibers due to differences in mechanical properties of the keratin layers and non-keratin under layers so as to distribute the catalyst solution to the non-keratin under layers;

b) a catalyst deposition step, which involves adjusting pH of the aqueous solution of step a) to induce the precipitation of the metal salt catalyst wherein said metal salt catalyst is precipitated at the under layers and;

c) a keratin layer removing step, comprising reacting at least one non-chlorine based oxidizing agent with the keratin fibers in the presence of the precipitated metal salt catalyst, to cause a rapid oxidation reaction at the non-keratin under layers so that the keratin layers may be removed from the non-keratin layers and the under layers may be exposed.

2. The method of claim 1, wherein said transition metal is selected from the group consisting of Cu, Fe, Ni, Co, Mn, Cr and Zn.

3. The method of claim 1, wherein said oxidizing agent is at least one of hydrogen peroxide and an oxidative acid selected from the group consisting of: monopersulfuric acid, dipersulfuric acid, hydrogen persulfuric acid, performic acid and peracetic acid, and salts of those acids.

4. The method of claim 3, wherein step (c) is carried out at a pH ranging from 7.5 to 10.5.

5. The method of claim 3, wherein the oxidizing agent is hydrogen peroxide and the oxidative acid.

6. The method of claim 1, wherein the method of adjusting the pH in step b) comprises adding strong electrolyte neutral metal salt at a concentration to cause precipitation of the catalyst and to suppress swelling of the under layers.

7. The method of claim 6, wherein said strong electrolyte neutral metal salt is a sodium salt or a potassium salt of a mineral acid and wherein said salt is added at a saturation or near saturation concentration.

8. The method of claim 1, wherein the aqueous solution in step (a) is used in a form where droplets of the aqueous solution are dispersed in an organic solvent.

9. The method of modifying keratin fibers of claim 1, wherein the method of adjusting the pH in step b) is accomplished by adding an acid.

10. The method of modifying keratin fibers of claim 1, wherein the method of adjusting the pH in step b) is accomplished by adding a solution of strong electrolyte neutral salt.

11. The method of modifying keratin fibers of claim 1, wherein the method of adjusting the pH in step b) is accomplished by partially drying the keratin fiber to remove water.

12. The method of modifying keratin fibers of claim 1, wherein the method of adjusting the pH in step b) is accomplished by adding an acid and a solution of strong electrolyte neutral salt.

13. The method of modifying keratin fibers of claim 1, wherein the method of adjusting the pH in step b) is accomplished by adding an acid and partially drying the keratin fiber to remove water.

14. The method of modifying keratin fibers of claim 1, wherein the method of adjusting the pH in step b) is accomplished by adding a solution of a strong electrolyte and partially drying the keratin fiber to remove water.

15. The method of modifying keratin fibers of claim 1, wherein the method of adjusting the pH in step b) is accomplished by adding an acid, adding a solution of strong electrolyte neutral salt, and partially drying the keratin fiber to remove water.

16. The method of modifying keratin fibers of claim 1, wherein the method of adjusting the pH in step b) is accomplished by adding a base.

17. The method of modifying keratin fibers of claim 1, wherein the method of adjusting the pH in step b) is accomplished by adding a base and partially drying the keratin fiber to remove water.

18. The method of modifying keratin fibers of claim 1, wherein the method of adjusting the pH in step b) is accomplished by adding a base, adding a solution of strong electrolyte neutral salt, and partially drying the keratin fiber to remove water.

19. The method of claim 1, wherein the keratin fiber is wool.

* * * * *